US009695374B2

(12) United States Patent
Lee et al.

(10) Patent No.: US 9,695,374 B2
(45) Date of Patent: Jul. 4, 2017

(54) METHOD FOR PRODUCING GAS HYDRATE BY REACTING PLURALITY OF GUEST GASES AND WATER

(71) Applicant: KOREA INSTITUTE OF INDUSTRIAL TECHNOLOGY, Chungcheongam-do (KR)

(72) Inventors: Ju Dong Lee, Busan (KR); Kyeong Chan Kang, Daegu (KR); Joung Ha Kim, Chungcheongnam-do (KR); Jae Il Lim, Daegu (KR)

(73) Assignee: Korea Institute Of Industrial Technology, Chungcheongnam-Do (KR)

( * ) Notice: Subject to any disclaimer, the term of this patent is extended or adjusted under 35 U.S.C. 154(b) by 30 days.

(21) Appl. No.: 14/421,934

(22) PCT Filed: Aug. 7, 2013

(86) PCT No.: PCT/KR2013/007120
§ 371 (c)(1),
(2) Date: Feb. 16, 2015

(87) PCT Pub. No.: WO2014/027787
PCT Pub. Date: Feb. 20, 2014

(65) Prior Publication Data

US 2015/0203773 A1 Jul. 23, 2015

(30) Foreign Application Priority Data

Aug. 17, 2012 (KR) ..... 10-2012-0090330

(51) Int. Cl.
*C10L 3/10* (2006.01)

(52) U.S. Cl.
CPC ..... *C10L 3/108* (2013.01)

(58) Field of Classification Search
None
See application file for complete search history.

(56) References Cited

U.S. PATENT DOCUMENTS 3,514,274 A * 5/1970 Johnston ..... F17C 11/007 48/190

FOREIGN PATENT DOCUMENTS

JP 2001-010985 A 1/2001
JP 2004346184 12/2004
(Continued)

OTHER PUBLICATIONS

First Office Action issued in Corresponding JP2015-527362 dated Feb. 2, 2016 (4 pages).
(Continued)

*Primary Examiner* — Tam M Nguyen
(74) *Attorney, Agent, or Firm* — Hovey Williams LLP

(57) ABSTRACT

The present invention provides a method for preparing gas hydrates by reacting a plurality of guest gases with water, wherein a first guest gas has a higher water solubility than that of a second guest gas, and the pressure of the gas hydrate formation condition of the second guest gas is lower than the pressure of the gas hydrate formation condition of the first guest gas.

While the traditional gas hydrate production method, wherein a single guest gas is reacted with water, is unsatisfactory in terms of cost effectiveness and productivity, the present invention provides improved production yield of gas hydrates and enables an easy production of gas hydrates at lower pressure.

7 Claims, 2 Drawing Sheets

(56) References Cited

FOREIGN PATENT DOCUMENTS

| | | | |
|---|---|---|---|
| JP | 2006-104385 | | 4/2006 |
| JP | 2006-104385 | A | 4/2006 |
| JP | 2006-295059 | A | 10/2006 |
| JP | 2009114055 | | 5/2009 |
| KR | 10-2010-0032189 | A | 3/2010 |
| KR | 10-2011-0035718 | A | 4/2011 |

OTHER PUBLICATIONS

International Search Report mailed Dec. 30, 2013 in Corresponding PCT Application PCT/KR2013/007120 (WO 2014/027787 A3) (5 pages).

Office Action in related Japanese Application No. JP 2015-527362 dispatch date Nov. 22, 2016 (English translation attached).

Making, et al., "Isothermal Phase Equilibria and Cage Occupancies for CH4+CHF3 Mixed-Gas Hydrate System" The Open Thermodynamics Journal, 2008, issue 2, pp. 17-21.

Kawamura, et al., "Thermodynamic investigation on hydrofluorocarbon-methane-TBAB clathrate hydrates for application to heat pump" The Japan Institute of Energy (English abstract attached).

Kunita, et al., "Raman Spectroscopic studies on methane+tetrafluoromethane mixed-gas hydrate system" Science Direct, vol. 251, issue 2. Feb. 15, 2007, pp. 145-148.

* cited by examiner

METHOD FOR PRODUCING GAS HYDRATE BY REACTING PLURALITY OF GUEST GASES AND WATER

RELATED APPLICATIONS

This application is the National Stage of International Patent Application No. PCT/KR2013/007120, filed Aug. 7, 2013, which is hereby incorporated by reference in its entirety, and which claims priority to Korean Patent Application No. 10-2012-0090330, filed Aug. 17, 2012.

TECHNICAL FIELD

The present invention relates to a method for preparing gas hydrates using a plurality of guest gases having different gas hydrate formation conditions (phase equilibrium conditions), and more particularly, to a method for preparing gas hydrates using a plurality of guest gases having different phase equilibrium conditions at relatively low pressure with high speed, by simultaneously injecting a first guest gas which has a high water solubility and a second guest gas which is reactive at low pressure into a reactor and reacting them with water.

BACKGROUND ART

A clathrate hydrate refers to a crystalline compound wherein guest molecules are physically trapped inside a three-dimensional lattice structure formed by hydrogen-bonded host molecules without a chemical bonding. When the host molecule is a water molecule and the guest molecule is a small-molecular-weight gas molecule such as methane, ethane, propane and carbon dioxide, it is called a gas hydrate.

The gas hydrate was first discovered in 1810 by Sir Humphry Davy of England. He reported during his Bakerian Lecture to the Royal Society of London that, when chlorine reacts with water, a compound resembling ice is formed, but the temperature thereof is higher than 0° C. Michael Faraday first discovered in 1823 that a gas hydrate is formed by a reaction of 10 water molecules with one chlorine molecule. Until now since then, the gas hydrate has been continuously studied as one of phase-change materials (PCMs). The main subjects of the study include phase equilibrium and formation/dissociation conditions, crystal structure, coexistence of different crystals, competitive compositional change in the cavity, etc. Besides, various detailed researches are being conducted in microscopic and macroscopic aspects.

At present, it is known that about 130 kinds of guest molecules can be trapped in the gas hydrate. Examples include $CH_4$, $C_2H_6$, $C_3H_8$, $CO_2$, $H_2$, $SF_6$, etc. The crystal structure of the gas hydrate has a polyhedral cavity which is formed by hydrogen bonded water molecules. Depending on the kind of the gas molecule and the condition of its formation, the crystal structure may vary to have a body-centered cubic structure I (sI), a diamond cubic structure II (sII) or a hexagonal structure H (sH). The sI and sII structures are determined by the size of the guest molecule and, in the sH structure, the size and the shape of the guest molecule are important factors.

The guest molecule of the gas hydrate naturally occurring in the deep sea and permafrost areas is mainly methane, and it has received attention as an environment-friendly clean energy source due to a small amount of carbon dioxide ($CO_2$) emissions during combustion. Specifically, the gas hydrate may be used as an energy source to replace traditional fossil fuels and may also be used for storage and transportation of solidified natural gas using the hydrate structure. Further, it may be used for separation and storage of $CO_2$ to prevent global warming and may also be beneficially used in seawater desalination apparatuses to dissociate gases or aqueous solutions.

In technologies utilizing the gas hydrate such as storage and transportation of solidified natural gas, seawater desalination, etc., the method of preparing the gas hydrates at relatively low pressure with high speed is an important factor in commercialization.

In the conventional methods, the reaction between the materials introduced into the reactor is facilitated by further adding a reaction promoter or by increasing the efficiency of heat exchange using a stirrer, a cooling jacket, etc., equipped inside or outside the reactor in order to promote the formation of the gas hydrates. However, the additional use of the promoter or the devices leads to increased cost and it is still practically difficult to maintain the gas hydrate formation rate enough to provide satisfactory cost-effectiveness and productivity at low temperature.

DISCLOSURE

Technical Problem

In order to solve the above-described problem, the present invention is directed to providing a method for preparing gas hydrates using a plurality of guest gases, by simultaneously injecting two guest gases which have different gas hydrate formation conditions (phase equilibrium conditions) and reacting them with water.

Preferably, a first guest gas which has a high water solubilityr and a second guest gas which forms a gas hydrate at a lower pressure than that of the first guest gas are used to prepare gas hydrates at relatively low pressure with high speed.

Technical Solution

In an aspect, the present invention provides a method for preparing gas hydrates by reacting a plurality of guest gases with water, wherein the plurality of guest gases include a first guest gas and a second guest gas the gas hydrate formation condition of which is different from that of the first guest gas.

Preferably, the first guest gas may have a higher water solubility under standard temperature and pressure (STP) than that of the second guest gas under the same condition, and the pressure of the gas hydrate formation condition of the second guest gas may be lower than that of the first guest gas.

Preferably, the first guest gas may have a water solubility of 0.5-10 g/L under standard temperature and pressure (STP).

Preferably, the pressure of the gas hydrate formation condition of the second guest gas may be lower than that of the first guest gas under a given temperature condition.

Preferably, the gas hydrate formation condition of the first guest gas may be at a temperature of 0-15° C. and a pressure higher than 10 atm and equal to or lower than 70 atm.

Preferably, the gas hydrate formation condition of the second guest gas may be at a temperature of 0-15° C. and a pressure equal to or higher than 1 atm and lower than 10 atm.

Preferably, the first guest gas may be $CH_4$ or natural gas, and the second guest gas may be any one selected from sulfur hexafluoride ($SF_6$), hydrofluorocarbons (HFCs) and perfluorocarbons (PFCs).

Preferably, the first guest gas may be $CO_2$ or $CH_4$, and the second guest gas may be any one selected from $SF_6$, HFCs and PFCs.

Preferably, the first guest gas may be any one selected from methane, natural gas and $CO_2$, and the second guest gas may be propane ($C_3H_8$).

Advantageous Effects

As described above, method for preparing gas hydrates using a plurality of guest gases according to the present allows for preparation of gas hydrates at low pressure with high speed as compared to the conventional method, by injecting a first guest gas which has a relatively high solubility to water and a second guest gas which is reactive at low pressure into a reactor and reacting them with water.

That is to say, while the conventional method for preparing a gas hydrate by causing a single guest gas to react with water is disadvantageous in terms of economy and productivity, the method of the present resolves such a problem and enables a preparation of gas hydrates at lower pressure with an improved yield of the gas hydrates.

BEST MODE FOR CARRYING OUT INVENTION

The above and other objects, features and advantages of the present invention will become more apparent from the following description of certain exemplary embodiments given in conjunction with the accompanying drawings. The described exemplary embodiments are provided for illustrative purposes only and are not intended to limit the technical scope of the present invention.

A method for preparing gas hydrates according to the present invention provides increased formation rate of gas hydrates and is applicable to any type of a gas hydrate preparation apparatus capable of preparing gas hydrates. A gas hydrate preparation apparatus, which is used for the method for preparing gas hydrates using a plurality of guest gases according to the present invention, may be prepared integrally or separately, as occasion demands. Also, some of its components may be omitted depending on the mode of operation.

The gas hydrate preparation apparatus to which the method of the present invention is applied may be used for various applications, including water treatment processes, natural gas hydrate (NGH) processes, separation-purification processes, contaminated gas removal processes, greenhouse gas separation-storage processes, hydrogen storage processes and processes and instruments for transportation and heat pumping. More specifically, the water treatment processes may include a seawater desalination process, a wastewater treatment process, a brackish water desalination process, a water purification process, an aquatic resources concentration process, a drug separation process, a vitamin purification process, and so forth.

Hereinafter, the method for preparing gas hydrates using a plurality of guest gases according to the present invention will be described in detail with reference to the accompanying drawings.

As used herein, the 'gas' refers to a guest molecule of a gas hydrate, and the water contained in seawater refers to a host molecule. Examples of the gas molecules that can be used to form gas hydrates include $CH_4$, $C_2H_6$, $C_3H_8$, $CO_2$, $H_2$, $SF_6$, etc.

A reaction intermediate produced in the method for preparing gas hydrates is referred to as a gas hydrate or a pelletized gas hydrate (hereinafter, gas hydrate) and a process of preparing the gas hydrate into pellets is referred to as pelletizing.

The method according to the present invention allows for improvement of yield as well as fast removal of impurities contained in gas hydrates by increasing reaction rate while lowering the pressure required for the reaction. During the process, gas hydrate pellets may also be prepared.

Overall Configuration of as Hydrate Preparation Apparatus 100

Figure 1:
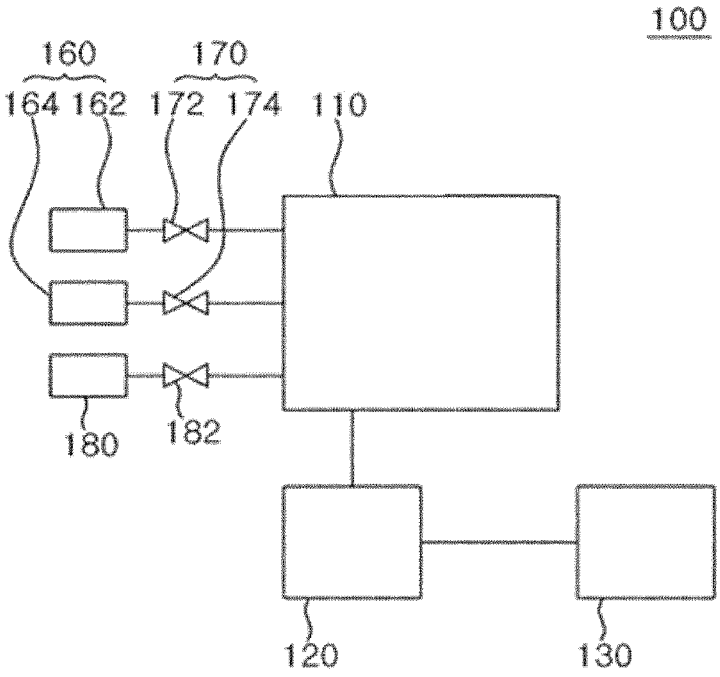
FIG. 1 shows the overall configuration of a gas hydrate preparation apparatus used in a method for preparing gas hydrates using a plurality of guest gases according to the present.

First, the overall configuration of a gas hydrate preparation apparatus 100 used in the present invention will be described referring to FIG. 1.

The gas hydrate preparation apparatus 100 of the present invention may be equipped with a temperature sensor and a pressure sensor at a reactor/supply sources and the sensors may be connected to and controlled by a controller. However, the sensors and the controller are not shown in the figure for the purpose of illustration.

In addition, although a control unit for a user to input operation parameters and to control the operation of the gas hydrate preparation apparatus 100 may be connected to the controller, it is also not shown in the figure for the purpose of illustration.

The figure is only a simplified schematic diagram for describing an exemplary embodiment of the gas hydrate preparation apparatus 100 according to the present invention and the scope of the present invention is not limited by the positions, arrangements, connections, etc. of the components shown in the figure.

The gas hydrate preparation apparatus 100 includes a reactor 110 wherein gas hydrates are formed from water and a plurality of guest gases, a dehydration tank 120 which prepares crystallized gas hydrates by compressing a gas hydrate slurry formed in the reactor 110, a storage tank 130 which separates some of guest gases and impurity components from the crystallized gas hydrates discharged from the dehydration tank 120, a gas supply source 160 which supplies the gases to the reactor 110, a gas control valve 170 which is disposed at a pipeline between the gas supply source 160 and the reactor 110, and a host molecule supply source 180 which supplies the water to the reactor 110. The gas supply source 160 includes a first guest gas supply source 162 and a second guest gas supply source 164, and the gas control valve 170 includes a first guest gas control valve 172 and a second guest gas control valve 174. A host molecule control valve 182 is disposed at a pipeline between the host molecule supply source 180 and the reactor 110.

Since the present invention aims at improving the capacity of gas hydrate formation, the components other than the reactor 110, such as the dehydration tank 120, the storage tank 130, etc. may be omitted.

In the reactor 110, the water to be treated, which includes impurities, and the plurality of guest gases are introduced and pure ingredient in the water to be treated and the plurality of guest gases react to form the gas hydrates as crystals. Although not shown in the figure, the reactor 110 may further include an additional stirring device (not shown) for stirring the introduced materials, a sensor (not shown), a heater (not shown) for melting the introduced materials if they are frozen, or the like.

Since the plurality of guest gases introduced into the reactor 110 have to be dissolved at high speed during the reaction with the water, they should include a first guest gas which has high solubility to water regardless of a pressure range. It is because, if the first guest gas is quickly dissolved in water, the gas-liquid reaction can be facilitated and the gas hydrate can be formed quickly.

Since the general physical condition inside the reactor where gas hydrates are formed is maintained at a temperature of 0-15° C. and a pressure equal to or lower than 70 atm, it is required that the first guest gas have high water solubility under the condition. Preferably, the first guest gas may have a solubility to water of 0.5-10 g/L under standard temperature and pressure (STP).

Apart from the first guest gas having high water solubility, a second guest gas, which can readily react with the host molecule at low pressure and thereby form the gas hydrate at relatively low pressure, is required. Preferably, in the present invention, the hydrate formation condition of the second guest gas may be a temperature of 0-15° C. and a pressure equal to or higher than 1 atm and lower than 10 atm. By lowering the pressure for reactor operation, the second guest gas can decrease the energy cost to be inputted.

Yield of Gas Hydrates when Plurality of Guest Gases are Used

Figure 2:
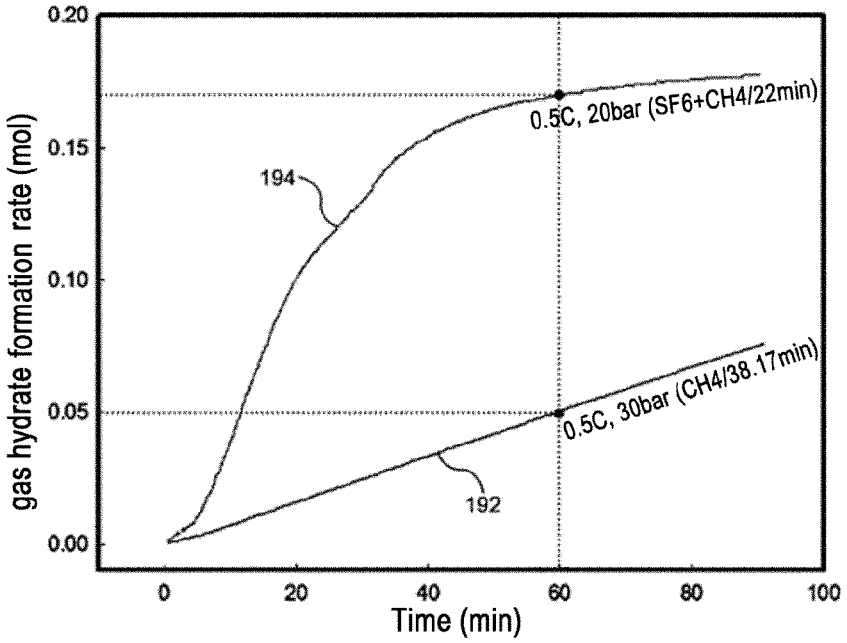
FIG. 2 compares a case where a single guest gas is injected into a reactor and a case where a plurality of guest gases are injected into a reactor according to an exemplary embodiment of the present invention.

Next, the improvement of the gas hydrate formation rate at low pressure resulting from the use of the plurality of guest gases will be described referring to FIG. 2. In the graph of FIG. 2, the abscissa represents reaction time and the ordinate represents gas hydrate formation rate.

In the present invention, a plurality of guest gases which includes a first guest gas which has high solubility to a host molecule and a second guest gas which is reactive at low pressure are injected into a reactor 110 to allow for a reaction at high speed.

Specifically, in the state where the plurality of guest gases are accommodated in the reactor, the first guest gas which has high solubility to water may react alone with the host molecule at a temperature of 0-15° C. and a pressure higher than 10 atm and equal to or lower than 70 atm. In this case, the first guest gas may have a water solubility of 0.5-10 g/L under standard temperature and pressure (STP). Meanwhile the second guest gas which can form a gas hydrate at a relatively lower pressure may act alone with the host molecule at a pressure equal to or higher than 1 atm and lower than 10 atm.

As described, in the present invention, the plurality of guest gases accommodated in the same reactor 110 independently react with the host molecule depending on pressures. The thermodynamic equilibrium of the plurality of guest gases in the reactor 110 allows them to behave stably.

In the graph of FIG. 2, the linear first curve 192 corresponds to the conventional general gas hydrate preparation process where a host molecule and a $CH_4$ gas as a single guest gas are injected into a reactor and caused to react under a condition of 0.5° C. and 30 atm. From the first curve 192, it can be seen that the time when the gas hydrate nucleus is first formed (induction time) is 38.17 minutes.

In the graph, the second curve 194 corresponds to the characteristic gas hydrate preparation process according to the present invention where a host molecule and $CH_4$ and $SF_6$ gases as a plurality of guest gases are injected into a reactor and caused to react under a condition of 0.5° C. and 20 atm. From the second curve 194, it can be seen that the time when the gas hydrate nucleus is first formed (induction time) is faster than when a single guest gas was used as 22 minutes.

To conclude, it can be seen from FIG. 2 that, under the same given reaction temperature of 0.5° C., the gas hydrate formation rate is 2-3 times faster when the plurality of guest gases $CH_4$ and $SF_6$ were injected even at lower pressure as compared to when the single guest gas was injected. For example, when the reaction time was 60 minutes, the consumption of the guest gas was about 0.05 mol in the first curve 192 whereas that of the second curve 194 exceeded 0.15 mol. That is to say, the consumption of $CH_4$ was about 3 times as high in the second curve 194.

Figure 3:
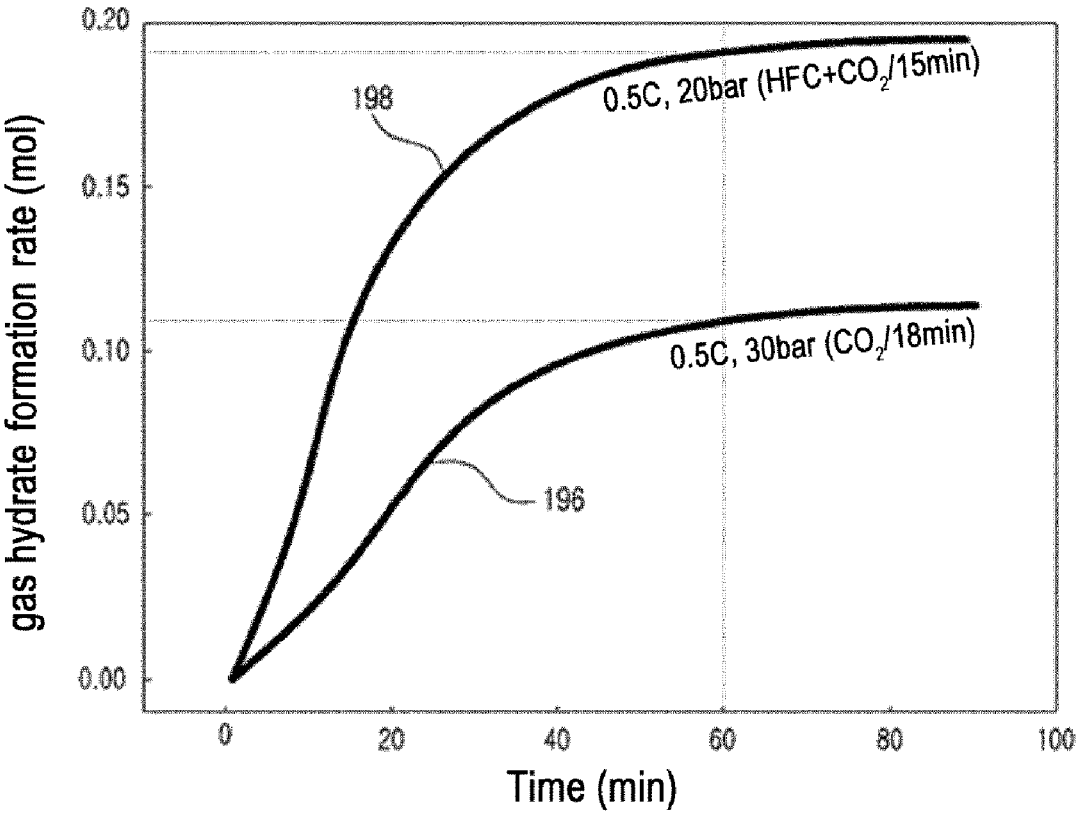
FIG. 3 compares a case where a single guest gas is injected into a reactor and a case where a plurality of guest gases are injected into a reactor according to another exemplary embodiment of the present invention.

In the graph of FIG. 3, the third curve 196 corresponds to the conventional general gas hydrate preparation process where a host molecule and a $CO_2$ gas as a single guest gas are injected into a reactor and caused to react under a condition of 0.5° C. and 30 atm. From the third curve 196, it can be seen that the induction time when the gas hydrate nucleus is first formed is 18 minutes.

In the graph, the fourth curve 198 corresponds to the characteristic gas hydrate preparation process according to the present invention where a host molecule and $CO_2$ and HFC gases as a plurality of guest gases are injected into a reactor and caused to react under a condition of 0.5° C. and 20 atm. From the fourth curve 198, it can be seen that the time when the gas hydrate nucleus is first formed (induction time) is faster than when a single $CO_2$ gas was used as 15 minutes.

It can be also seen from FIG. 3 that, under the same given reaction temperature of 0.5° C., the gas hydrate formation rate is 2-3 times faster when the plurality of guest gases $CO_2$ and HFC were injected even at lower pressure as compared to when the single guest gas was injected. In addition, it can be seen that the gas hydrate formation rate is faster when $CO_2$ and HFC were injected than when $CH_4$ and $SF_6$ were injected.

These results show that, as compared to when $CH_4$ or $CO_2$ alone is used as a guest gas, the reaction pressure can be lowered and at the same time the reaction rate can also be increased when a plurality of guest gases are simultaneously injected into a reactor, thereby increasing the formation of gas hydrates. The increased production of gas hydrates provides advantages in terms of productivity and economy.

As described above, the method for preparing gas hydrates using a plurality of guest gases according to the present invention, wherein a first guest gas which has relatively high water solubility and a second guest gas which is reactive at low pressure are injected into reactor and caused to react with a host molecule, allows for preparation of gas hydrates at lower pressure with high speed, as compared to the conventional method.

While the exemplary embodiments of the present invention have been described, the present invention is not limited by the specific embodiments. Those skilled in the art will appreciate that the various changes and modifications may be made to the present invention without departing from the spirit and scope of the invention as set forth in the appended claims and that such equivalent embodiments are within the spirit and scope of the present invention.

The invention claimed is:

1. A method for preparing gas hydrates by reacting a plurality of guest gases with water, wherein the plurality of guest gases comprise a first guest gas and a second guest gas at a gas hydrate formation condition of which is different from that of the first guest gas, wherein a pressure of the gas hydrate formation condition of the second guest gas is lower than that of the first guest gas, and wherein the plurality of guest gases are accommodated in a same reactor and independently react with water depending on pressures.

2. The method for preparing gas hydrates by reacting the plurality of guest gases with water according to claim 1, wherein the first guest gas has a higher water solubility under standard temperature and pressure (STP) than that of the second guest gas under the same condition.

3. The method for preparing gas hydrates by reacting the plurality of guest gases with water according to claim 1, wherein the first guest gas has a water solubility of 0.5-10 g/L under standard temperature and pressure (STP), and the pressure of the gas hydrate formation condition of the second guest gas is lower than that of the first guest gas.

4. The method for preparing gas hydrates by reacting the plurality of guest gases with water according to claim 1, wherein the gas hydrate formation condition of the first guest gas refers to a temperature of 0-15° C. and a pressure higher than 10 atm and equal to or lower than 70 atm, and the gas hydrate formation condition of the second guest gas refers to a temperature of 0-15° C. and a pressure equal to or higher than 1 atm and lower than 10 atm.

5. The method for preparing gas hydrates by reacting the plurality of guest gases with water according to claim 1, wherein the first guest gas is $CH_4$ or natural gas, and the second guest gas is any one selected from $SF_6$, $HFC_S$ and $PFC_S$.

6. The method for preparing gas hydrates by reacting the plurality of guest gases with water according to claim 1, wherein the first guest gas is $CO_2$, and the second guest gas is any one selected from $HFC_S$, $PFC_S$ and $SF_6$.

7. The method for preparing gas hydrates by reacting a plurality of guest gases with water according to claim 1, wherein the first guest gas is any of methane, natural gas and $CO_2$, and the second guest gas is propane ($C_3H_8$).

* * * * *